US005890477A

United States Patent [19]

Nazare

[11] Patent Number: 5,890,477

[45] Date of Patent: Apr. 6, 1999

[54] DEVICE FOR INJECTING A FUEL GAS MIXTURE INTO A COMBUSTION ENGINE

[76] Inventor: Edgard Nazare, 9, place Vauban, 75007 Paris, France

[21] Appl. No.: 817,170

[22] PCT Filed: Oct. 18, 1995

[86] PCT No.: PCT/FR95/01372

§ 371 Date: Jun. 23, 1997

§ 102(e) Date: Jun. 23, 1997

[87] PCT Pub. No.: WO96/12886

PCT Pub. Date: May 2, 1996

[30] Foreign Application Priority Data

Oct. 19, 1994 [FR] France ..... 94 12453

[51] Int. Cl.[6] ..... F02M 29/02

[52] U.S. Cl. ..... 123/592; 261/76; 239/399; 239/418

[58] Field of Search ..... 123/590, 592; 261/76, 84, 35; 239/399, 400, 418

[56] References Cited

U.S. PATENT DOCUMENTS 3,544,290 12/1970 Larson, Sr. et al. ..... 123/592
3,615,296 10/1971 Guarnaschelli ..... 123/592
3,955,548 5/1976 Thomas, Jr. ..... 123/592
4,982,716 1/1991 Takeda et al. ..... 123/531
5,638,797 6/1997 Kim ..... 123/592

FOREIGN PATENT DOCUMENTS 484681 10/1991 European Pat. Off. .

*Primary Examiner*—John T. Kwon
*Attorney, Agent, or Firm*—Oblon, Spivak, McClelland, Maier & Neustadt, P.C.

[57] ABSTRACT

A device for transforming internal combustion engines using liquid fuel into over-pressurized engines using gas. Liquid fuel is fed into an annular chamber surrounding a needle. The fuel and primary air is injected at a controlled flow and pressure into a choke chamber to form an air-fuel premixture made of very fine microdrops. During the downstroke of the piston, the premixture is aspirated, causing the projection of the premixture against the blades of a rotor which rotates at high speed. The gasification chamber is then over pressurized during the closing of the intake valve and the introduction of the mixture.

20 Claims, 3 Drawing Sheets

DEVICE FOR INJECTING A FUEL GAS MIXTURE INTO A COMBUSTION ENGINE

BACKGROUND OF THE INVENTION

1. Field of the Invention

The present invention relates to a device for the transformation of internal combustion engines using liquid fuel, into gas, over-pressurised engines.

2. Discussion of the Background

At the present time, only two types of fuel feeding devices for automobile engines are known: carburettors, generally of the float type, and sequential projection injectors. The main drawbacks arising from the projection into the cylinders of liquid fuel pulvesed into more or less fine drops, in collaboration with a certain volume of air, are essentially an incomplete internal combustion of the air-fuel mixture in the cylinders, which causes a fairly rapid soiling of the cylinders, poor yield and increased environmental pollution through the unburned particles in the air-fuel mixture. The soiling of the cylinders rapidly destroys the lubrication features of the engine lubricant because of the particles and soot generated by the unburned fuel. This provokes the premature damaging of the piston rings and skirts of the engine, and that of the crankshaft bearings and the piston rods, in the case of high pressure feeding diesel engines. Very high pressure feeding requires the use of high accuracy pumps, and thus is very expensive, as well as a feeding circuit adapted to resist such pressures. The injection system is also very accurate and expensive and easily liable to go out of adjustment.

In order to overcome such drawbacks, car manufacturers have been researching mechanical, electrical or thermal means which involve, among other features, with a pre-chamber preceding the classical distributor. However, the improvement provided to engines, more generally petrol engines, cannot be carried out on the so called diesel engines, which are provided with high pressure injection devices at 150 bar. The tendency is to further increase the accuracy of the injection, in order to feed each cylinder with exactly the same amount of fuel. This, together with the fact that the means of control are becoming more sophisticated and expensive, causes an increase in the likelihood of breakdown. They have as a drawback the fact that they easily go out of order. Generally, the know devices need continual, expensive maintenance, which is rarely warranted by the users, but is by the professionals in the art, who are equipped with the appropriate tools.

It is to be noted that the problem of automobile pollution, mainly due to heavy fuel consumption, arising from the continuous growth of world-wide automotive park, has become a main concern in all developed countries, and so it will in all the developing countries, where the automotive park is rapidly being extended.

The problems which the invention seeks to overcome are the following:

- to eliminate the pollution of petrol and diesel internal combustion engines, specially the pollution generated by diesel engines in the so-called "heavy weighted" vehicles, but also in marine engines, electrical power generation engines, and so on, by removing the unburned particles,
- to reduce the fuel consumption by about a 20%;
- to markedly improve the efficiency of such engines;
- to increase their life span;
- to diminish the exploitation, maintenance and adjustment costs.

SUMMARY OF THE INVENTION

The device according to the invention succeeds in the specified goals by providing a novel and simple means for the gasification, at the molecular level, of the air-fuel mixture in a premixing chamber and in a gasification chamber adapted to the intake of each cylinder of internal combustion engines.

It is devised to replace carburettors or injectors in any type of petrol engines and particularly to eliminate pressure feeding in diesel power engines which are the most pollutant, and amongst them, those with which heavy weighed vehicles are furnished, public works engines, marine engines, and so on. The disclosed gasification means transforms classical liquid fuel, internal combustion engines into gas engines.

The auto-ignition pressure inside diesel engines, of about 23 to 24 bar, is thus lowered so as to eliminate the auto-ignition which is needed in a fuel feeding under high pressure. The ignition is obtained by means of a high voltage, electronic ignition facility and the engine is over-pressurised by means of a compressor which allows it to recover all its power by turning at a higher rotation speed when needed. At slow speed it works at low power, thus further lowering the fuel consumption.

According to a preferred embodiment, the device according to the invention comprises:

- a gasification chamber provided in each cylinder, directly connected to the intake of all the explosion chambers of the said engine,
- a means for injecting liquid fuel under a pressure of 5 to 7 bar,
- a means for injecting primary air under a pressure of 2 to 4 bar,
- a means for injecting secondary air under a pressure of some hundreds of millibar,
- a micro chamber for the diffusion and the making of a air-fuel pre-mixture:
- a means for eliminating, for mixing and for the molecular breaking-up of the air-fuel mixture, transforming it into a homogeneous gas within each of the said chambers, under a pressure of about between 100 and 400 millibar,
- means for electronically controlling the synchronous operation of the valve needles, of the air intake, for optimising the air-fuel mass ratio, and for controlling the pressurised liquid fuel distribution pump,
- an high voltage electronic ignition facility.

Upon the closing of the intake valve of each engine cylinder, the gasification chamber is submitted to a permanent over-pressure by means of a multi-blade propeller, caused to rotate at a high speed by the exit pressure in the previous air-fuel mixture. On the opening of the intake valve of each cylinder, gas pressure within the gasification chamber drops when it enters the explosion chamber, undergoing a high depression because of the reciprocating motion of the engine piston. This arrangement provides for the transformation of the air-fuel pre-mixture into a gas, which allows its complete combustion within the explosion chamber, no unburned residue being detectable in the exhaust gases. The flow variation of the fuel which enters the gasification chamber is obtained by a means of fuel pump rotation variation.

The advantages shown by the pressurised gasification device according to the invention are the following:

- total breaking-up at a molecular level, and transformation of the air-fuel mixture into homogeneous gas within the gasification chamber before the intake into the explosion chamber, thus resulting in the total lack of unburned gas at the engine exhaust gases outlet, and therefore a very important reduction of the air pollution owing to these gases, this pollution being almost limited to that of CO2;

great simplification of the feeding of the internal combustion engines and a remarkable reduction in the costs of this function;

removal of carburettors, and their inherent drawbacks, and removal of direct injection, which is day by day replacing carburettors, which increases the fuel consumption and the volume of unburned gases;

significant improvement of efficiency and life span of internal combustion engines, since gases are totally burned;

fuel saving of about 20% and lubricant saving, since the frequency of lubricant change is reduced to less than half;

improvement of lubrication and a longer engine life span, together with cheaper maintenance;

very short return period of the device over-cost, on the basis of fuel, lubricant, maintenance and engine life span savings.

ease of adaptation on any existing kind of internal combustion engines and particularly for diesel engines.

The installation of the novel gasification equipment on diesel engines requires the withdrawal of the air trap, the injectors and the present pressure feeding system (high pressure pump and hydraulic part), installation of a spark plug in place of each cylinder injector, placement of a bed joint for increasing the volume of the explosion chambers, installation of a gasification block on an adaptation support for each engine type, installation of a compressor, an electronic ignition facility operating at at least 40,000 volts, and a facility for the regulation of the physical, fluid and mechanical parameters of the engine within the novel equipment.

BRIEF DESCRIPTION OF THE DRAWINGS

The device according to the invention is described in detail in the text that follows, in connection with the attached drawings, given only by way of non-limiting examples, in which are shown.

DISCUSSION OF THE PREFERRED EMBODIMENTS

Figure 1:
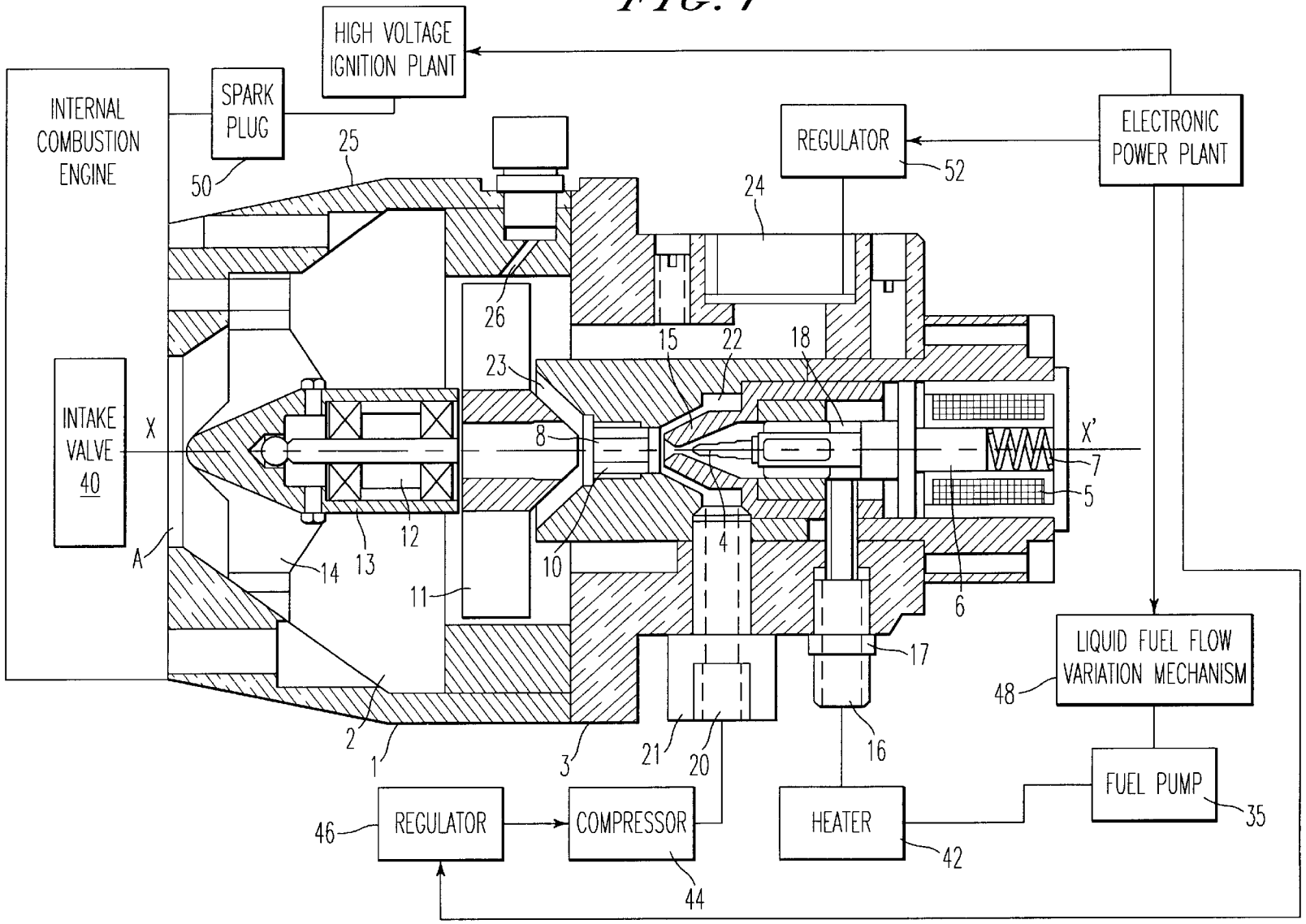
FIG. 1, an elevation section of an assembly of the device according to the invention.

As shown in FIG. 1, the device is embodied in a gasification block 1 comprising a gasification chamber 2, fixed directly or through an adaptation support, by a screw assembly at the right side of the gas admission hole A inside each motor cylinder which it is connected to. Chamber 2 is closed by a body 3 provided on its longitudinal axis XX' with a sliding needle injection device 4, urging a cock into an opening position and a closing position. It is for example actuated by means of an electromagnetic coil 5 that attracts its core 6, which is in a normally closed position by means of a compression spring 7.

The fuel is injected under a pressure of about from 5 to 7 bar on a choke 8, whose function is to reduce the pressure inside a pre mixing micro chamber 10 by forming an air-fuel pre-mixture which is then projected against the blades of a multi-blade propeller 11, which rotates within a bearing 12 concentrically to the axis XX' of the gasification block. The said propeller generates the removal and the homogenisation, by means of mixing, of the air-fuel pre-mixture at the choke 8.

The propeller bearing 12 is, for instance, located inside a bearing support 13, comprising arms 14 provided with screw means for its fixation on the body 1 of the chamber 2. The propeller 11 rotates freely on its cushion. Its number of blades depends on the high rotation speed to be achieved in order to break-up the gas mixture at a molecular level, from 3,000 to 20,000 turns/minute, according to the engine speed. The liquid fuel is driven through a pipe 16 and a coupling 17, to an annular chamber 18 surrounding the needle 4 and comprising fuel passing slots; the edge portions of the said slots also act as a guide into the bore of the needle support. The primary compressed air, generated by an auxiliary compressor, flows trough a pipe 20 and a coupling 21, into an annular chamber 22 which leads into the pre-mixing chamber 10. The fuel and the pre-mixed air flow through a conical hole 23, against the blades of the propeller 11; simultaneously, additional secondary air, entering from a side hole 24, also flows against the blades of the propeller 11. The optimisation of the primary and secondary air volumes is adjusted according to the fuel flow provided by a controlled flow pump in collaboration with a variable opening electrovalve. The air-fuel pre-mixture, injected in the form of micro-drops against the propeller 11, is then broken-up, in collaboration with the temperature in the gasification chamber 2, into a quasi-molecular level, transforming it into an over-pressurised gas before it enters the engine cylinder.

The complete cycle is carried out according to the following steps:

1) feeding of the liquid fuel, at a pressure of from 5 to 7 bar, into the annular chamber 18 of the needle 4;
2) injection of the fuel and the primary air, at a controlled flow and pressure, into the chamber 10 on the choke, thus forming an air-fuel pre-mixture already comprised of very fine micro-drops;
3) aspiration in 3 upon the down stroke of the piston, causing a depression inside the conical hole 23 which leads to the gasification chamber 2 and projection of the fine micro-drops pre-mixture against the blades of the propeller 11, which is rotating at a high speed alternately by means of the said depression of the chamber 2, owing to the down stroke of the piston, and of the air-fuel injection pressure;
4) over pressurising the inside of the chamber 2, during the closing of the intake valve and the introduction of the mixture under pressure,
5) putting the chamber 2 into depression upon the opening of the valve at the beginning of a new cycle.

The rotation speed of the propeller 11 is mainly a function of the depression, ranging that rotation speed from about 3,000 to 20,000 turns/minute, which is high enough to assure the breaking-up of the pre-mixture.

This result is achieved in a very inexpensive fashion. A needle 4 is used, which is opened or closed in order to govern a continuous flow, instead of an impulsion flow as occurs in the majority of classic engines. The speed variation of the fuel pump associated to a variable opening electrovalve provides for the necessary flow according to the engine speed. This variation could also be achieved by any other known means. Upon the starting of the engine and at low speed of the latter, the propeller rotation is assisted by an electric motor, not represented, and at higher speeds, by the air under pressure projected in 26, tangential against the blades of the propeller 11.

The amounts of fuel, primary air and secondary air are dosed by means of an electronic facility for governing and co-ordinating the physical, flow and mechanical parameters, especially the rotation speed of the thermal engine, temperature and pressure. The mass ratio of the air-fuel mixture depends on the said different parameters.

In the case of adapting the gasification equipment on the existing diesel engines, the high pressure pump and its hydraulic equipment are withdrawn, and so are the injectors, a bed joint is introduced to increase the volume enclosed by the explosion chambers and to reduce the compression relationship below the auto-ignition threshold, a spark plug is mounted instead of the injector in each cylinder, and collaborates with a high-voltage, ignition, electronic facility, of at least 40,000 volts, to generate the ignition spark for the gas mixture; the gasification blocks are mounted on a support, adapted to each type of engine and fixed on the air trap bores; The high pressure injection pump is replaced by a variable flow pump, which operates at a low pressure of about from 5 to 7 bar.

Figure 2:
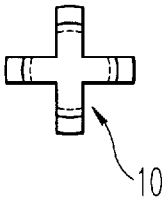
FIG. 2 and 3, the choke located inside the pre-mixing chamber.
Figure 3:
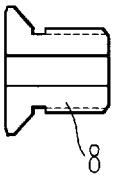

FIG. 2 and 3 show, in an end elevation view, an example of choke 8 located inside the premixing chamber 10. The said choke is in the form of a cross-shaped, threaded part provided with skirts, screwed and retained concentrically to the axis XX' and facing the outlet of the injector 15 at the right side of the latter.

Figure 4:
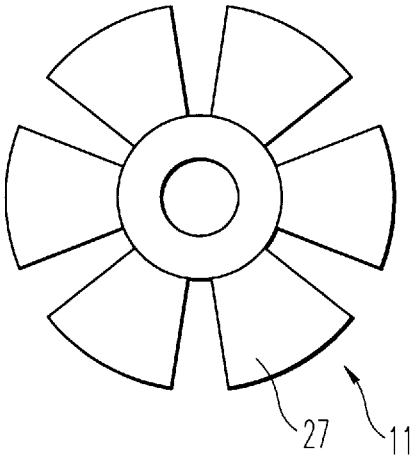
FIG. 4 and 5, a front view and a section view of the propeller for the mixing and the removal of the gas mixture.
Figure 5:
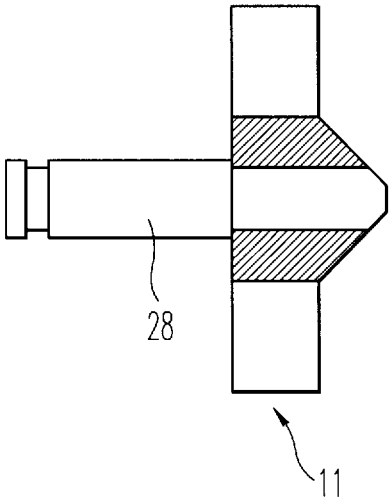

FIG. 4 and 5 show a front view and a sectional elevation view of an example of an over-pressurising propeller 11, provided with 6 blades 27, the hub of which is integral with the shaft 28 within which is inserted in a cantilevered fashion, freely turning within its bearing.

Figure 6:
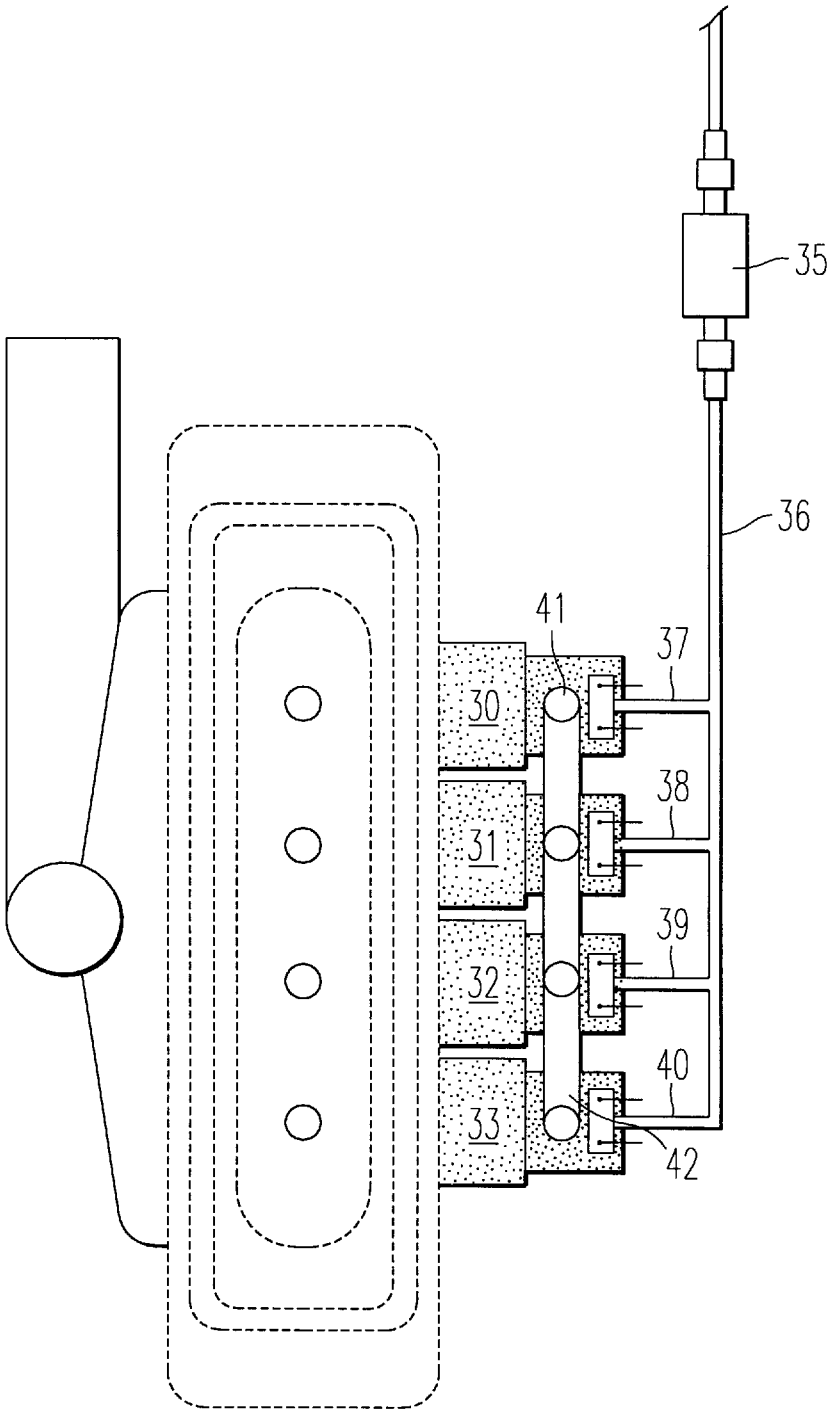
FIG. 6 a schematic view of the gasification blocks assembly arranged on a four cylinder engine.

FIG. 6 schematically shows a view of an assembly of gasification blocks 30, 31, 32 and 33, each comprising its own gasification chamber 2 on the right side of the engine cylinders. The gasification chambers 2 are under a constant over-pressure, of some bars, by means of their propeller 11, for the intake of additional air coming from an eventual turbo compressor and mainly from an auxiliary over-compressor, not represented.

The adjusting of the fuel under pressure, which has entered the pre-mixing chambers 10 is obtained, at a normal rotation speed of the internal combustion engine, by a known means for the variation of the rotation speed of a pump 35, causing the fuel to flow at a pressure of from 5 to 7 bar through a common pipe 36 which distributes the fuel to each of the four gasification blocks through the tubes 37, 38, 39, 40.

This fuel flow variation of the pump collaborates with a variable opening electrovalve so as to improve the adjustment of such flow.

In order to further improve the gasification, an electrical means is provided, e.g. a heating resistor, for over-heating the fuel prior to its injection inside the pre-mixing chamber. The primary air coming from the compressor is also hot, this fact easing the gasification inside the said chamber 10.

What is claimed is:

1. An air-fuel injection device for an internal combustion engine using a liquid motor fuel including a liquid motor fuel injection mechanism cooperating with an air intake mechanism generating a mixture to be admitted into each of the cylinders of said engine, said fuel infection device comprising:

a gasification unit for each cylinder of an internal combustion engine, said gasification unit comprising:

an air-fuel premixing chamber, including an outlet configured for discharging an air-fuel premixture;

an injection mechanism communicating with said premixing chamber, said injection mechanism configured to supply fuel to said premixing microchamber;

a pressurized primary air input communicating with said premixing chamber, said pressurized primary air input configured to provide a primary flow of pressurized air to said premixing chamber;

a gasification chamber communicating with said outlet of said premixing chamber and in direct communication with an intake orifice of a combustion chamber of said internal combustion engine;

a high-speed rotor provided in said gasification chamber and rotatably mounted proximate to said outlet of said premixing chamber such that said air-fuel premixture leaving said premixing chamber is directed onto at least one blade of said high-speed rotor; and a secondary air input communicating with said high-speed rotor, said secondary air input configured to provide a secondary flow of air to at least one blade of said high-speed rotor.

2. The device according to claim 1, wherein said premixing chamber comprises an antisplash plug to encourage the constitution of the premixture.

3. The device according to claim 2, wherein said high-speed rotor comprises a multiblade rotor placed concentric to a longitudinal axis of said gasification unit, said high-speed rotor rotatably mounted to a body of said gasification chamber and positioned at said outlet of said premixing chamber; wherein said multiblade rotor is configured to be rotated by a pressure of the air-fuel premixture when said premixture is drawn from said gasification chamber through said intake orifice when an intake valve of said internal combustion engine is opened.

4. The device according to claim 3, further comprising:

an air compressor configured to compress said primary flow of air to a pressure of 2 to 4 bars by an air compressor, and wherein said secondary air flow is supplied to said gasification chamber at a pressure of several hundred millibars.

5. The device according to claim 2, further comprising:

an air pipe communicating with said blades of said multiblade rotor wherein said pipe is configured to direct pressurized air onto a periphery of said blades during start up and slow speed operation of said internal combustion engine.

6. The device according to claim 2, further comprising:

an air compressor configured to compress said primary flow of air to a pressure of 2 to 4 bars by an air compressor, and wherein said secondary air flow is supplied to said gasification chamber at a pressure of several hundred millibars.

7. A device according to claim 2, wherein said internal combustion engine is a diesel engine, said device further comprising:

a brace joint provided between an engine block and a cylinder head of said diesel engine, said brace joint configured to lower a compressor rate of said cylinder below an autoignition threshold;

a spark plug mounted in an injector position for each cylinder;

a low pressure fuel pump is mounted in place of the high pressure pump;

an auxiliary primary air supply compressor mounted near the diesel engine; and a high voltage ignition plant configured to power said spark plug sequentially;

wherein said gasification unit is mounted in a collector position, opposite said intake orifice toward each combustion chamber of the engine using an adapter part consistent with a diesel engine.

8. The device according to claim 1, wherein said high-speed rotor comprises a multiblade rotor placed concentric to a longitudinal axis of said gasification unit, said high-speed rotor rotatably mounted to a body of said gasification chamber and positioned at said outlet of said premixing chamber; wherein said multiblade rotor is configured to be rotated by a pressure of the air-fuel premixture when said premixture is drawn from said gasification chamber through said intake orifice when an intake valve of said internal combustion engine is opened.

9. The device according to claim 8, further comprising:

an air pipe communicating with said blades of said multiblade rotor wherein said pipe is configured to direct pressurized air onto a periphery of said blades during start up and slow speed operation of said internal combustion engine.

10. The device according to claim 8, further comprising:

an air compressor configured to compress said primary flow of air to a pressure of 2 to 4 bars by an air compressor, and wherein said secondary air flow is supplied to said gasification chamber at a pressure of several hundred millibars.

11. The device according to claim 1, further comprising:

an air pipe communicating with said blades of said multiblade rotor wherein said pipe is configured to direct pressurized air onto a periphery of said blades during start up and slow speed operation of said internal combustion engine.

12. The device according to claim 1, further comprising:

an air compressor configured to compress said primary flow of air to a pressure of 2 to 4 bars by an air compressor, and wherein said secondary air flow is supplied to said gasification chamber at a pressure of several hundred millibars.

13. The device according to claim 1, further comprising:

a mechanism configured to vary a flow of liquid motor fuel to said injection mechanism;

means for regulating a pressure of said primary air flow;

means for regulating said secondary air flow as a function of a speed of fuel and a speed of said primary air flow in order to optimize the air-fuel ratio;

a high voltage ignition plant for spark plugs of said internal combustion engine;

an electronic power plant configured to coordinate physical, fluid and mechanical parameters of the operation of said internal combustion engine, said electronic power plant controlling said mechanism for varying the flow of liquid motor fuel, said means for regulating the primary pressure, said means for regulating the admission of secondary air, and said high voltage ignition plant.

14. The device according to claim 1, further comprising:

a common manifold configured to distribute liquid fuel to each injection mechanism by fuel lines; and a variable opening solenoid valve cooperating with a mechanism for varying the rotation speed of a fuel pump which provides fuel to said common manifold.

15. The device according to claim 1, further comprising an electric heating mechanism configured to reheat the fuel prior to its injection into the premixing chamber.

16. A air-fuel gasification unit for an internal combustion engine, comprising:

an air-fuel premixing chamber, including an outlet configured for discharging an air-fuel premixture;

an injection mechanism communicating with said premixing chamber, said injection mechanism configured to supply fuel to said premixing chamber;

a pressurized primary air input communicating with said premixing chamber, said pressurized primary air input configured to provide a primary flow of pressurized air to said premixing chamber;

a gasification chamber communicating with said outlet of said premixing chamber and in direct communication with an intake orifice of a combustion chamber of said internal combustion engine;

a high-speed rotor provided in said gasification chamber and rotatably mounted proximate to said outlet of said premixing chamber such that said air-fuel premixture leaving said premixing chamber is directed onto at least one blade of said high-speed rotor;

a secondary air input communicating with said high-speed rotor, said secondary air input configured to provide a secondary flow of air to at least one blade of said high-speed rotor.

17. A method for injecting air-fuel mixture into an internal combustion engine which includes a liquid motor fuel injection mechanism cooperating with an air intake mechanism generating a mixture to be admitted into each of the cylinders of said engine, said fuel infection device comprising a gasification unit for each cylinder of an internal combustion engine, said gasification unit comprising, an air-fuel premixing chamber, including an outlet configured for discharging an air-fuel premixture, an injection mechanism communicating with said premixing chamber, said injection mechanism configured to supply fuel to said premixing chamber, a pressurized primary air input communicating with said premixing chamber, said pressurized primary air input configured to provide a primary flow of pressurized air to said premixing chamber, a gasification chamber communicating with said outlet of said premixing chamber and in direct communication with an intake orifice of a combustion chamber of said internal combustion engine, a high-speed rotor provided in said gasification chamber and rotatably mounted proximate to said outlet of said premixing chamber such that said air-fuel premixture leaving said premixing chamber is directed onto at least one blade of said high-speed rotor, a secondary air input communicating with said high-speed rotor, said secondary air input configured to provide a secondary flow of air to at least one blade of said high-speed rotor, said method comprising the steps of:

supplying a pressurized liquid motor fuel to the injection mechanism;

injecting the fuel and primary air flow at a controlled rate and pressure into the premixing chamber thereby forming a pressurized air-fuel premixture;

spraying the pressurized premixture onto blades of the high-speed rotor thereby providing a rotational force on the high-speed rotor;

aspiring the premixture into an intake orifice of the internal combustion engine thereby contributing to rotation of the high-speed rotor, alternately contributing to the rotation of the high-speed rotor by partial vacuum in the gasification chamber caused by dissent of a piston in a combustion chamber communicating with the gasification chamber through said intake orifice and by the air-fuel injection pressure at the outlet of the premixing microchamber;

providing excess pressure in the gasification chamber upon closure of the intake valve following the introduction of the pressurized premixture into the combustion chamber;

providing partial vacuum in the gasification chamber upon opening of the valve for another cycle.

18. The method according to claim 17, wherein said step of supplying pressurized liquid motor fuel further comprises varying the flow rate of the pressurized liquid motor fuel by varying the rotation speed of a fuel pump with a variable opening solenoid valve wherein the fuel pump is configured to direct fuel to the injection mechanism through a common manifold and fuel lines attached thereto.

19. The method according to claim 17, wherein said internal combustion engine comprises a diesel engine which further comprises:

a brace joint added between an engine block of the diesel engine and a cylinder head of the diesel engine, said brace joint configured to lower a compression rate to below an autoignition threshold;

a spark plug mounted in an injector position for each cylinder;

a low pressure fuel pump mounted in place of the high pressure pump;

an auxiliary primary air supply compressor mounted near the diesel engine; and a high voltage ignition plant added to sequentially power said spark plug;

wherein the gasification unit is mounted in a collector position, opposite the intake orifice toward each combustion chamber of the diesel engine using an adapter part consistent with a diesel engine.

20. A method according to claim 17, further comprising the step of heating the fuel prior to its injection into the premixing chamber.

* * * * *